US008459215B2

(12) United States Patent
Hurst et al.

(10) Patent No.: US 8,459,215 B2
(45) Date of Patent: Jun. 11, 2013

(54) ACTUATING MECHANISM FOR A REGULATED COOLANT PUMP

(75) Inventors: Sebastian Hurst, Bubenreuth (DE); Markus Popp, Bamberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/401,928

(22) Filed: Feb. 22, 2012

(65) Prior Publication Data

US 2012/0291723 A1 Nov. 22, 2012

(30) Foreign Application Priority Data

May 19, 2011 (DE) ..... 10 2011 076 137

(51) Int. Cl.
*F01P 5/10* (2006.01)

(52) U.S. Cl.
USPC ..... 123/41.44; 123/41.47

(58) Field of Classification Search
USPC ..... 123/41.08, 41.11, 41.44–41.47; 415/131; 417/228
See application file for complete search history.

(56) References Cited

FOREIGN PATENT DOCUMENTS

| | | |
|---|---|---|
| DE | 19901123 | 7/2000 |
| DE | 10057098 | 3/2002 |
| DE | 102005062200 | 2/2007 |
| DE | 102005004315 | 4/2007 |

*Primary Examiner* — Lindsay Low
*Assistant Examiner* — Syed O Hasan
(74) *Attorney, Agent, or Firm* — Volpe and Koenig, P.C.

(57) ABSTRACT

A regulatable coolant pump for a cooling circuit of an internal combustion engine having a pump housing with a hollow pump shaft with an impeller. Rotation of the impeller moves coolant. An axially displaceable guide disk on the impeller controls a pump displacement volume and works via an actuating mechanism. The guide disk is rigidly connected to a connecting rod guided in the pump shaft. The actuating mechanism includes a displacement pump integrated in the coolant pump, and an actuator formed as a piston-cylinder unit with a pressure chamber in the pump housing that has a circular annular shape positioned to coincide with an outer region of the guide disk. A piston that works together with the guide disk is guided in linearly displaceable fashion in the pressure chamber. A coolant flow of the displacement pump controlled by a control valve charges the pressure chamber to displace the piston.

13 Claims, 3 Drawing Sheets

ACTUATING MECHANISM FOR A REGULATED COOLANT PUMP

CROSS-REFERENCE TO RELATED APPLICATIONS

This application claims the benefit of German Patent Application No. 102011076137.3, filed May 19, 2011, which is incorporated herein by reference as if fully set forth.

FIELD OF THE INVENTION

The present invention relates to a coolant pump having a regulatable coolant flow, preferably provided for a cooling circuit of an internal combustion engine. In the pump housing of the coolant pump, a pump shaft fashioned as a hollow shaft with an associated impeller is rotatably mounted. A rotation of the impeller conveys a coolant via an intake connection into a spiral duct of the coolant pump, a displacement volume of the coolant pump is capable of being influenced by an axially displaceable guide disk that cooperates with an actuating mechanism or actuator system and is allocated to the impeller. For this purpose, the guide disk is connected in rotationally rigid fashion to a connecting rod guided in the hollow shaft of the impeller, and is capable of being displaced between two end positions, which are defined by a rear wall and a pump cover of the impeller.

BACKGROUND

In liquid-cooled, in particular water-cooled, internal combustion engines, the cooling water is pumped by a coolant pump in a closed circuit through cooling ducts of the engine block that supports the crankshaft and of the cylinder head, and the heated coolant is subsequently conducted into an air-water heat exchanger or cooler, where the water is cooled back down by vehicle airflow, or by a ventilator when the vehicle is stationary. The coolant pump that supports a circulation of the coolant is conventionally directly driven by a traction drive, in particular a belt drive, a traction mechanism connecting the belt pulleys of the crankshaft and of the coolant pump. An immediate coupling between the coolant pump and the crankshaft provides that the rotational speed of the pump is a function of the rotational speed of the internal combustion engine. It results from this that, when there is a cold start of the internal combustion engine, the coolant circulates, causing a delay in a desirable fast warming up of the internal combustion engine and in the reaching of an optimal operating temperature connected therewith.

In order to avoid this effect, regulatable coolant pumps are used whose displaced volume flow can be matched to a cooling requirement of the internal combustion engine. Using regulated coolant pumps, frictional losses can be minimized, because as the oil temperature increases the viscosity of the lubricant oil, and consequently the friction, is reduced, which has a favorable effect on the fuel consumption. At the same time, an improved exhaust gas emission is achieved, because the efficiency of the catalytic converter requires a minimum exhaust gas temperature, and a shorter span of time required to reach this temperature has an immediate positive effect on exhaust gas emissions. In the cold running phase of the internal combustion engine, automobile manufacturers desire a coolant flow of ≦0.5 l/h, also referred to as "zero leakage flow." In the context of a new development of internal combustion engines for achieving energetically and thermo-mechanically improved operation, a savings in fuel of ≧2.5% was realizable under test conditions in connection with optimal thermal management.

As a measure for influencing the displacement volume of a coolant pump, from DE 199 01 123 A1 it is known to allocate to the open impeller a slider that overlaps the blades of the impeller and that modifies the effective blade width and that can be moved continuously in the axial direction and set at any position. The adjustment of the slider between an open position and closed position takes place by rotating a threaded-type guide. The regulatable coolant pump known from DE 100 57 098 A1 has a magnetic coil that works together with an armature disk and is displaceably situated in rotationally fixed, spring-loaded fashion on the drive shaft. Due to friction pads by which the impeller is connected to the armature disk, when the magnet is not energized the impeller is driven.

DE 10 2005 004 315 A1 and DE 10 2005 062 200 A1 show further regulatable coolant pumps in each of which a valve slide is attached that is displaceable in the direction of the axis of the pump shaft in order to influence the flow rate in the pump housing. The annular valve slide forms an outer cylinder that variably overlaps the outflow region of the impeller. According to DE 10 2005 004 315 A1, the valve slide, which can also be designated a guide disk, is electromagnetically displaced by a magnetic coil situated in the pump housing. Alternatively, according to DE 10 2005 062 200 A1 a pneumatically or hydraulically actuated actuator is provided for the displacement of the valve slide.

SUMMARY

The object of the present invention is to create a regulatable coolant pump whose actuating mechanism can be housed within the axial packaging limits of conventional pumps.

According to the present invention, this object is achieved by the present invention, which provides an actuating mechanism, also referred to as an actuator system, containing a displacement pump integrated inside the coolant pump, an actuator, and a control valve. The overall actuating mechanism is thus integrated inside the regulated coolant pump. The actuator, fashioned as a piston-cylinder unit, has a pressure chamber that has a circular annular shape and agrees with an outer region of the guide disk and is positioned in the pump housing, and is intended to accommodate an axially displaceable piston that works together with the guide disk. Through the use of a control valve, the coolant flow of the displacement pump that charges the pressure chamber can be influenced, thus immediately influencing the position of the guide disk. With this actuating mechanism according to the present invention, using the actuator a precise positioning of the guide disk can take place in order to provide a volume flow matched to the particular cooling requirement of the internal combustion engine. In this way, in particular after a cold start a rapid heating of the internal combustion engine can be realized, connected with a reduction of frictional losses and of fuel consumption, and consequently of pollutant emissions. In addition, in long-term operation, by providing a precise displacement volume with the coolant pump, the engine temperature can be adjusted to the current load state of the internal combustion engine.

In order to achieve the targeted adjustment of the coolant flow or of the volume flow, the guide disk or guide plate is advantageously displaced axially relative to the impeller by an actuating mechanism that is as neutral as possible with regard to the available space in the axial direction, and that therefore does not require adaptation to the surrounding construction, for example the drive of the coolant pump. The actuating mechanism according to the present invention is therefore capable of being integrated within the axial packaging boundaries of conventionally constructed coolant pumps made up of a belt drive, bearing, sliding ring seal, and impeller. The actuating mechanism design according to the present invention moreover enables an integrated assembly of all components, together with a compact construction form that is simple and robust from the point of view of manufacturing and assembly and that can be economically designed so as to be standardizable for different sizes of coolant pumps. The integrated displacement pump can be made smaller due to the pressure piston-guide disk, preferably forming an assembly, because this constructive design has a relatively large piston surface. In addition, the actuating mechanism that is maximally integrable into the existing constructive space of the coolant pump for the active influencing of the coolant flow rate is distinguished by high operational safety and reliability, and by a high degree of volumetric efficiency. The actuating mechanism is advantageously realizable with a low manufacturing and assembly expense. Moreover, a conventional coolant pump can be immediately exchanged for a coolant pump having an actuating mechanism according to the present invention. In contrast to previous solutions that provide an electromagnetic or electromechanical actuation of the guide disk, the present invention has an actuation based on hydraulic pressure, such that the displacement pump integrated in the coolant pump compresses the cooling medium in order to produce the hydraulic pressure. In contrast to a known solution in which an oil hydraulic system of the internal combustion engine displaces the guide disk, the coolant used for actuation according to the present invention brings about a self-sufficiently produced hydraulic pressure. This less critical actuation energy does not require any additional hydraulic connections, for example between the internal combustion engine and the pump housing, and also does not require an increased sealing expense in order to effectively prevent oil from entering the coolant of the internal combustion engine.

Further features and advantages of the present invention result from the claims, from the drawings, and from the associated description of the Figures.

According to a preferred embodiment of the present invention, it is provided to use as displacement pump a geared pump whose driving gear is advantageously connected in rotationally rigid fashion to the pump shaft and whose driven gear is at least indirectly rotatably mounted in the pump housing. The two gears running in opposite directions of the displacement pump, which form a gear pump having an intake connection and a pressure connection, engage one another at the intake side of the pump. The hydraulic fluid enters into open tooth gaps of the gears, and due to the rotation the hydraulic fluid is conveyed to the pressure connection via the region enclosed by the pump housing. Due to the engagement of the two gears that takes place, the hydraulic fluid is pressed out of the tooth gaps into the pressure connection of the pump. Instead of a geared pump, other displacement or delivery pumps may also be used that are capable of being integrated into the coolant pump in order to displace the guide disk. As a measure for simplifying assembly, the present invention includes a displacement pump that can be placed axially into the pump housing of the coolant pump as a pre-assembled unit. Advantageously, the displacement pump, realized in particular as a pre-manufactured geared pump containing all components, can be assembled in automated fashion so as to optimize costs.

A preferred actuator design includes a pressure chamber formed as a circular ring, in particular manufactured without machining, forming a formed sheet metal part having a U-shaped cross-sectional profile, pressed into a wet region of the pump housing. Alternatively, according to the present invention a pressure chamber made of a suitable plastic may be used. The pressure chamber, set into a corresponding opening of the pump housing, is connected to the control valve and/or to the displacement pump via at least one hydraulic or pressure connection. In the pressure chamber, open at one side, a piston that works together with the outer contour of the guide disk can be placed so as to be linearly displaceable and sealed. Here a recommended option is for the guide disk to be connected in one piece to the piston, such that this unit is advantageously manufactured without machining. The piston guided in the pressure chamber preferably forms a 180° flange at the end side having a U-shaped cross-sectional profile. This piston shape is connected immediately to the cylindrical part, the outer diameter of the guide disk, resulting in an optimal pressure applied to the piston surface and thus to the actuator for adjusting the guide disk. Depending on the quality of the displacement of the displacement pump, a seal is provided between the movable piston and the stationary pressure chamber. Sufficient displacement pressure permits leakage of the coolant into the pressure chamber. If leakage is to be prevented, a recommended solution is to fully exploit the pressure energy of the displacement pump and to minimize the leakage by using suitable seals.

In addition, the control valve is allocated to a pressure line that connects a pressure side of the displacement pump to the pressure chamber in the pump housing. A bore or a separate line made inside the coolant pump in the pump housing can be provided as pressure line or pressure medium connection. Preferably, the control valve that works together with the actuator is positioned as an assembly inside the coolant pump, via which valve the coolant flow, or its pressure potential, is forwarded to the actuator and thus to the piston of the guide disk depending on the positioning requirement. Alternatively, the present invention includes a control valve situated outside or separate from the coolant pump. Independent of the position of installation, control valves may be used that can be actuated electrically, magnetically, pneumatically, or hydraulically, via which the hydraulically acting actuator can be activated. In the operating state, the control valve is preferably controlled by a control unit or by an engine management system of the internal combustion engine.

In order to ensure cooling of the internal combustion engine even given failure of the actuating mechanism, the actuator includes a failsafe device or failsafe coupling. This device or coupling has a device connected to the actuator, preferably including a spring device. In the event of a failure or drop in pressure of the displacement pump, the spring device causes the piston, including its associated guide disk, to automatically be displaced into a position that corresponds to a maximum opening of the impeller and thus the largest flow rate of the coolant pump. A preferred design provides that the spring device is situated in the pressure chamber of the actuator between a stationary fixed point and the piston. Alternatively, the spring device can be placed between the connecting rod and the pump housing.

BRIEF DESCRIPTION OF THE DRAWINGS

Further features of the present invention result from the following description of drawings in which a preferred exemplary embodiment is presented.

DETAILED DESCRIPTION OF THE PREFERRED EMBODIMENTS

Figure 1:
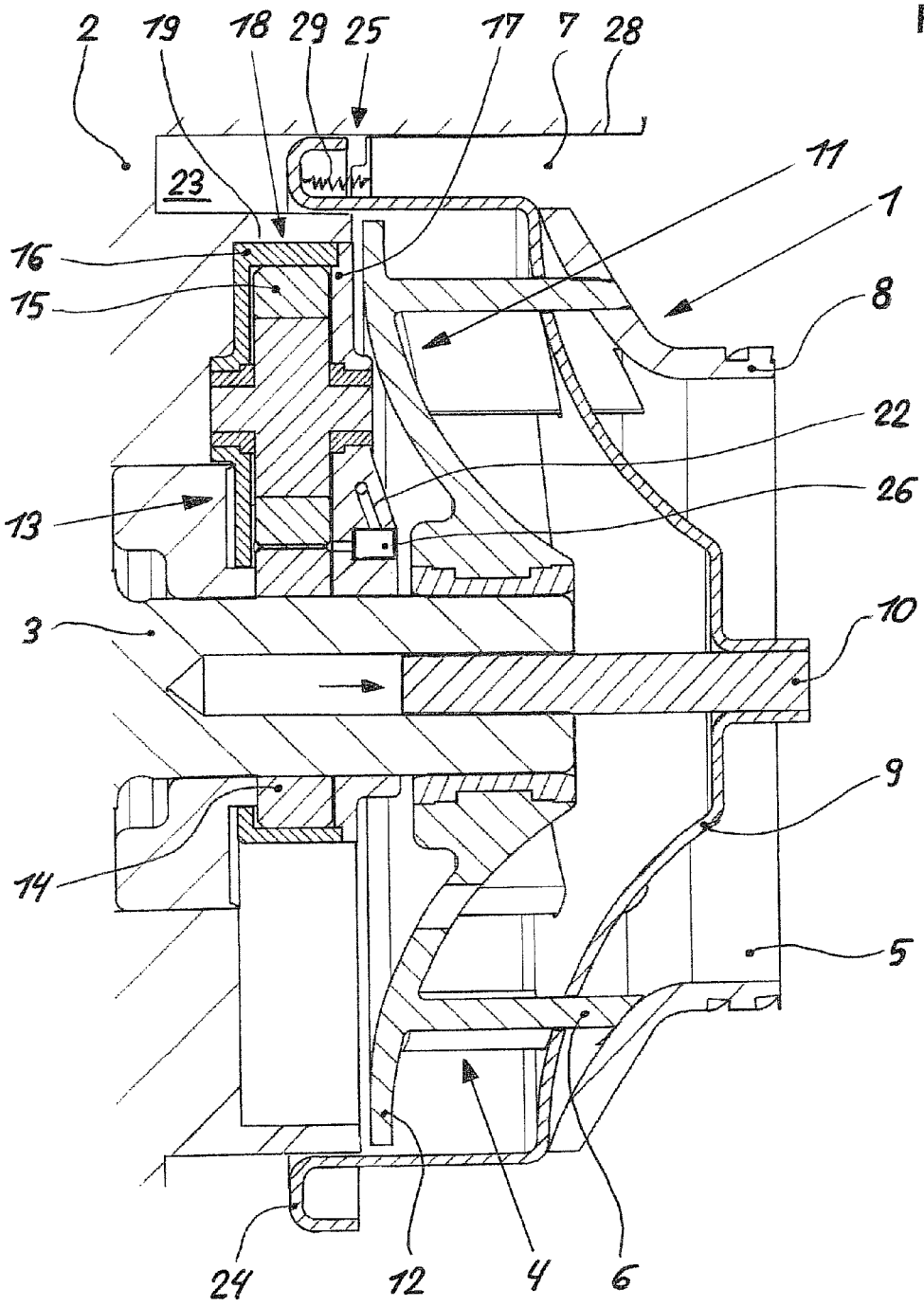
FIG. 1 shows a regulatable coolant pump according to the present invention in a longitudinal section.

FIG. 1 shows a regulatable cooling pump 1 in a longitudinal section, having a pump housing 2 in which there is mounted a pump shaft 3 fashioned as a hollow shaft, connected in rotationally rigid fashion to an impeller 4. When impeller 4 rotates in the operating state of coolant pump 1, a coolant, in particular cooling water, flows axially via an intake connection 5 to impeller 4 and is conducted radially via blades 6 into a spiral duct 7. Here, a pump cover 8 connected to impeller 4 forms a transition to intake connection 5. In order to influence the displacement volume of coolant pump 1, a guide disk 9 is provided that is axially displaceable and that variably overlaps an outflow region of impeller 4 and is rotationally fixed to a connecting rod 10 that is displaceable relative to pump shaft 3. Using an actuating mechanism 11 or actuator system, also designated a displacing unit, guide disk 9 can be continuously positioned between two end positions defined by pump cover 8 and a rear wall 12. According to FIG. 1, guide disk 9 is supported on pump cover 8, causing impeller 4 to be closed and thus setting a zero conveying state of coolant pump 1. The actuating mechanism 11 comprises a displacement pump 13 that is integrated inside coolant pump 1 and is realized as a geared pump, whose driving gear 14 is connected in rotationally fixed fashion to pump shaft 3 and engages a driven gear 15 that is mounted in radially offset fashion in pump housing 2 so as to be indirectly rotatable. Gears 14, 15 of displacement pump 13, an associated housing 16, and an end face cover 17 together form a unit 18 capable of pre-assembly that can be axially placed into a corresponding opening 19 in pump housing 2. In the operating state of coolant pump 1, coolant flows via an intake side 20 shown in FIG. 2 into the displacement pump 13, and is conducted from a pressure side 21 into a pressure line 22 (FIG. 1) or pressure line 27 (FIG. 2) that opens into a pressure chamber 23 that is formed as a circular annular opening 28 made in pump housing 2. Together with a piston 24, pressure chamber 23 forms a piston-cylinder unit, which is actuator 25 of actuating mechanism 11. Piston 24, connected to an outer cylindrically oriented segment of guide disk 9, forms a U-shaped cross-sectional profile made by a 180° flange, which is held with a positive fit, sealed to the greatest possible extent, in pressure chamber 23. Guide disk 9 including piston 24 is preferably made from a steel plate by a non-machining forming method. Through the use of a control valve 26 allocated to pressure line 22, pressure chamber 23 can be charged as needed with the coolant in order to displace piston 24, together with associated guide disk 9, in the direction of the arrow. The control valve 26, which is for example controlled electronically, is preferably connected to a control unit of an internal combustion engine not shown in FIG. 1, such that the required coolant flow can be supplied via the correspondingly set guide disk 9 immediately as a function of the operating temperature of the internal combustion engine or taking into account further parameters. In order to ensure functioning of coolant pump 1 when there is a failure of actuating mechanism 11, actuating mechanism 11 includes a failsafe device 29. For this purpose, a spring device, in particular a pressure spring, is provided that is placed between piston 24 and a stationary linkage point inside spiral duct 7. When there is a drop in pressure inside pressure chamber 23, failsafe device 29 brings about an automatic resetting of piston 24 in order to cause guide disk 9 to be seated on rear wall 12.

Figure 2:
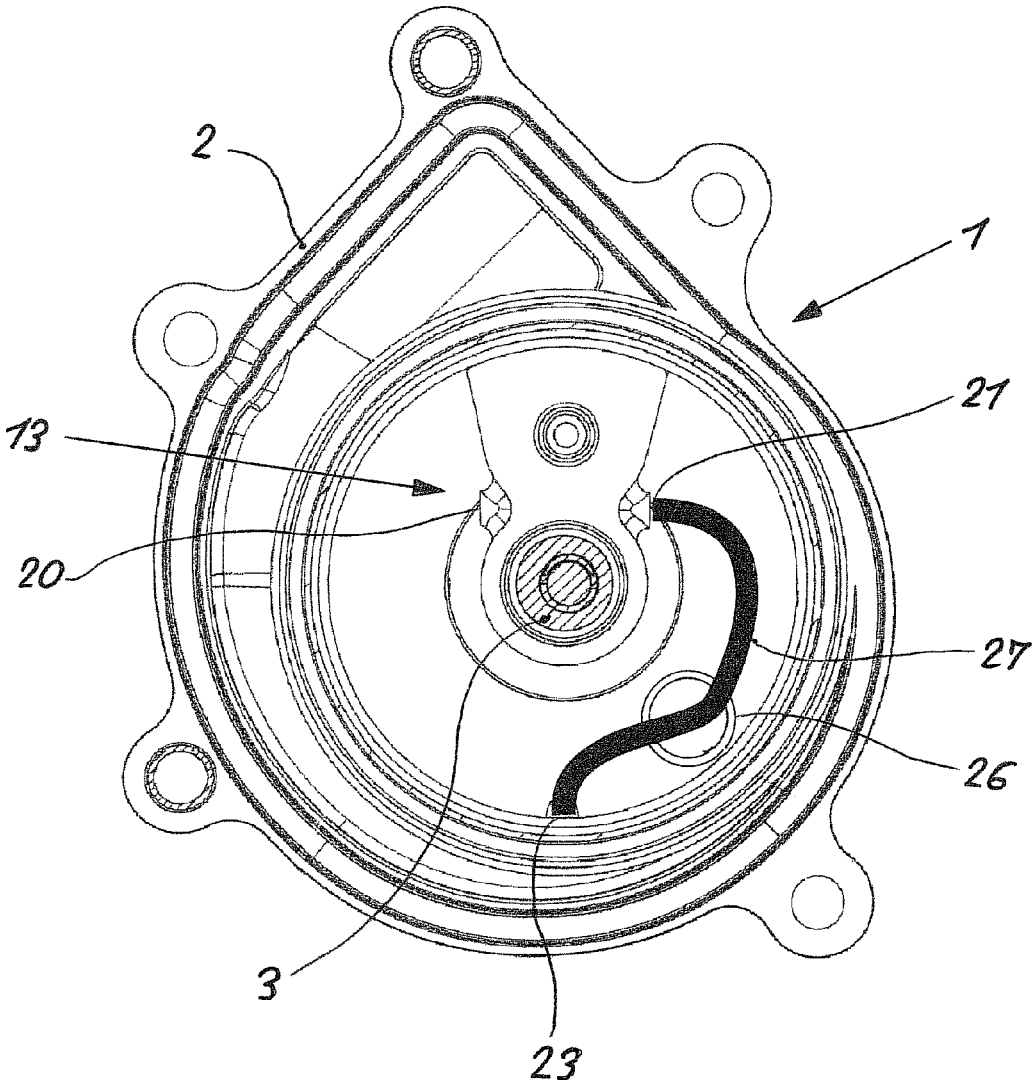
FIG. 2 shows a portion of the coolant pump according to FIG. 1.

FIG. 2 shows, in particular, displacement pump 13 integrated in coolant pump 1. The coolant enters displacement pump 13 via intake side 20, and thus via the intake connection. Alternatively to FIG. 1, which has an integrated pressure line 22, a pressure line 27 runs as a separate line outside pump housing 2 and connects pressure side 21 of displacement pump 13 to pressure chamber 23. Here, the pressure line 27, formed as a pipe conduit, is simultaneously connected to the control valve 26.

Figure 3:
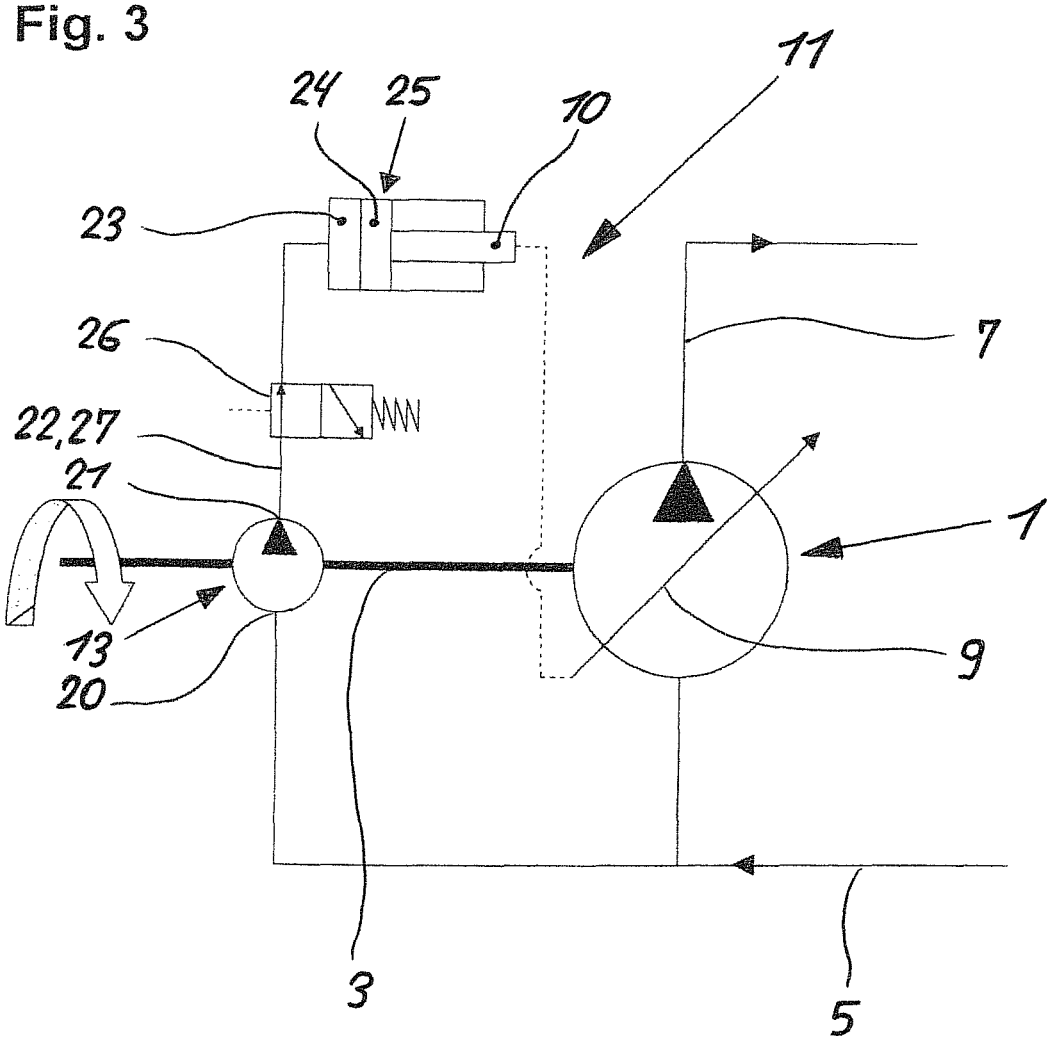
FIG. 3 shows a schematic representation of the design of the actuating mechanism according to the present invention for a regulated coolant pump.

FIG. 3 schematically illustrates the design of actuating mechanism 11 according to the present invention, all components of coolant pump 1 being depicted separately. A partial quantity of the coolant entering coolant pump 1 via intake connection 5 enters displacement pump 13 via intake side 20, and is conducted via pressure side 21 into pressure line 22 or 27, to control valve 26, and subsequently to pressure chamber 13 of actuator 25. Here there takes place an application of pressure to piston 24, such that its actuating movement is transmitted via connecting rod 10 to guide disk 9, by which the displacement volume of coolant pump 1 can be directly influenced.

LIST OF REFERENCE CHARACTERS

1 coolant pump
2 pump housing
3 pump shaft
4 impeller
5 intake connection
6 blade
7 spiral duct
8 pump cover
9 guide disk
10 connecting rod
11 actuating mechanism
12 rear wall
13 displacement pump
14 gear (driving)
15 gear (driven)
16 housing
17 cover
18 assembly
19 opening
20 intake side
21 pressure side
22 pressure line
23 pressure chamber
24 piston
25 actuator
26 control valve
27 pressure line
28 opening
29 failsafe device

The invention claimed is:

1. A coolant pump having a regulatable coolant flow that can be placed into a cooling circuit of an internal combustion engine, comprising: a pump housing in which a hollow pump shaft with an associated impeller is rotatably mounted such that rotation of the impeller conveys coolant via an intake connection into a spiral duct of the coolant pump, a displacement volume of the coolant pump being adjustable by an axially displaceable guide disk allocated to the impeller that is actuatable via an actuating mechanism, the guide disk is connected in rotationally rigid fashion to a connecting rod that is held in the pump shaft and is displaceable between two end positions defined by a rear wall of the housing and a pump cover for the impeller, the actuating mechanism includes a displacement pump integrated in the coolant pump, as well as an actuator comprised of a piston-cylinder unit having a pressure chamber inside the pump housing complementarily positioned to an outer region of the guide disk, in which a piston that moves together with the guide disk is guided, and a control valve that controls a coolant flow of the displacement pump that charges the pressure chamber.

2. The coolant pump as recited in claim 1, wherein the displacement pump comprises a gear pump having a driving gear connected in rotationally rigid fashion to the pump shaft and a driven gear mounted in the pump housing so that it is at least indirectly rotatable.

3. The coolant pump as recited in claim 1, wherein the pressure chamber, fashioned as a plate formed part having a U-shaped cross-sectional profile, is placed into an opening of the pump housing, and a pressure line connects the pressure chamber to the displacement pump.

4. The coolant pump as recited in claim 1, wherein the guide disk is connected in one piece to the piston that externally surrounds the impeller (4) and is guided in the pressure chamber.

5. The coolant pump as recited in claim 4, wherein the guide disk is manufactured without machining and includes in an outer region a U-shaped profile that forms the piston.

6. The coolant pump as recited in claim 1, wherein a pressure side of the displacement pump is connected to the pressure chamber by a pressure line formed in the pump housing.

7. The coolant pump as recited in claim 6, wherein the control valve of the actuating mechanism is connected to the pressure line.

8. The coolant pump as recited in claim 1, wherein the control valve is integrated as an assembly in the coolant pump.

9. The coolant pump as recited in claim 1, wherein the actuator acts hydraulically and is capable of being activated via the control valve that is actuated electrically, magnetically, pneumatically, or hydraulically.

10. The coolant pump as recited in claim 1, wherein the actuator includes a failsafe device which upon failure of the actuating mechanism, displaces the guide disk in a direction of a maximum displacement volume of the coolant pump.

11. The coolant pump as recited in claim 1, wherein a pressure side of the displacement pump is connected to the pressure chamber by a pressure line realized as a separate line.

12. The coolant pump as recited in claim 11, wherein the control valve of the actuating mechanism is connected to the pressure line.

13. The coolant pump as recited in claim 1, wherein the control valve is positioned outside the coolant pump.

* * * * *